US011123844B2

(12) United States Patent
Kang et al.

(10) Patent No.: US 11,123,844 B2
(45) Date of Patent: Sep. 21, 2021

(54) ELECTRICAL CLAMPING DEVICE

(71) Applicant: Energium Co., Ltd., Seoul (KR)

(72) Inventors: Junghun Kang, Seoul (KR); Kanghee Lee, Seoul (KR); Jongwon Kim, Seoul (KR); Youngjae Jeon, Seoul (KR); Kyungsung Chu, Seoul (KR)

(73) Assignee: ENERGIUM CO., LTD., Seoul (KR)

( * ) Notice: Subject to any disclaimer, the term of this patent is extended or adjusted under 35 U.S.C. 154(b) by 208 days.

(21) Appl. No.: 16/514,483

(22) Filed: Jul. 17, 2019

(65) Prior Publication Data

US 2020/0101583 A1 Apr. 2, 2020

(30) Foreign Application Priority Data

Oct. 2, 2018 (KR) ..... 10-2018-0117718

(51) Int. Cl.

| | |
|---|---|
| ***B25B 5/12*** | (2006.01) |
| ***B25B 5/04*** | (2006.01) |
| ***B25B 5/16*** | (2006.01) |
| ***B25B 11/00*** | (2006.01) |

(52) U.S. Cl.

CPC ..... *B25B 5/12* (2013.01); *B25B 5/04* (2013.01); *B25B 5/16* (2013.01); *B25B 11/00* (2013.01)

(58) Field of Classification Search

CPC .... B25B 5/12; B25B 5/04; B25B 5/16; B25B 5/08; B25B 5/10; B25B 5/103; B25B 11/00; B25B 5/064; B25B 5/122; B23Q 3/06

USPC ..... 269/24–27, 32, 91, 94, 201, 216, 225, 269/226, 227, 237

See application file for complete search history.

(56) References Cited

U.S. PATENT DOCUMENTS

| | | | | |
|---|---|---|---|---|
| 5,676,357 | A * | 10/1997 | Horn | B25B 5/122 269/201 |
| 6,471,199 | B2 * | 10/2002 | Nagai | B25B 5/12 269/32 |
| 6,845,975 | B2 * | 1/2005 | Tunkers | B25B 5/122 269/225 |
| 6,869,068 | B2 * | 3/2005 | Zhao | B25B 5/06 269/228 |
| 6,976,671 | B2 * | 12/2005 | Migliori | B23Q 11/08 269/32 |
| 7,367,434 | B2 * | 5/2008 | Sato | B25B 5/12 188/72.1 |
| 2006/0197270 | A1 * | 9/2006 | Migliori | B25B 5/16 269/228 |
| 2006/0208408 | A1 * | 9/2006 | Migliori | B25B 5/122 269/32 |

(Continued)

*Primary Examiner* — Orlando E Aviles
*Assistant Examiner* — Robert F Neibaur
(74) *Attorney, Agent, or Firm* — Devlin Law Firm LLC; James M. Lennon

(57) ABSTRACT

Provided is an electric clamping device including a main body; a drive motor for providing a driving force; a driving force transfer portion for converting and transferring a magnitude of a driving force of the drive motor; a sliding crank having one side connected to the driving force transfer portion and for converting a rotational motion of the driving force transfer portion to a reciprocating motion; a toggle link having one side connected to the other side of the sliding crank and including an elastically deformable link; and a clamp having one side connected to the toggle link and having the other side for clamping or unclamping an object. Various other embodiments are available.

10 Claims, 11 Drawing Sheets

(56) References Cited

U.S. PATENT DOCUMENTS

2015/0145195 A1* 5/2015 Fukui ..... B25B 5/16
269/32

* cited by examiner

ELECTRICAL CLAMPING DEVICE

CROSS-REFERENCE TO RELATED APPLICATION(S)

This application is based on and claims priority under 35 U.S.C. § 119 to Korean Patent Application No. 10-2018-0117718, filed on Oct. 2, 2018, in the Korean Intellectual Property Office, the disclosure of which is incorporated by reference herein in its entirety.

BACKGROUND OF THE INVENTION

Field of the Invention

The present invention relates to a clamping device for grasping a panel, and more particularly, to an electric clamping device that can reduce an overall size, improve a grasping torque through an improved driving force transfer structure, and stably grasp a panel of various thicknesses.

Description of the Related Art

In general, a clamping device is a device for fixing a panel when performing a processing operation such as a transportation operation of a panel, a cutting operation, and a welding operation, and grasping torques or grasping portions may be different according to a sectional thickness of a panel in each processing operation, and structures of the clamping device may be also different.

A conventional clamping device grasped a panel mainly using a cylinder using a pneumatic pressure or a hydraulic pressure. However, such a clamping device has an increased size because of a pneumatic or hydraulic pressure supply pipe for an operation of the cylinder as well as a size of the cylinder and has a complicated operating structure.

Further, in order to change a grasping torque to grasp panels of various thicknesses, there is a problem that a driving force transfer mechanism is changed or that a separate clamping device having different grasping torques should be provided.

Accordingly, it is necessary to develop a driving force transfer mechanism capable of improving or changing a grasping torque so as to grasp panels of various thicknesses while having the above structure.

SUMMARY OF THE INVENTION

The present invention has been made in view of the above problem and provides an electric clamping device that can reduce an overall size by using a motor as a drive source and that can greatly improve a grasping torque by applying a sliding crank, a guide groove, and a transformed toggle link.

The present invention further provides an electric clamping device that can increase a movement range of a clamp body through a guide groove formed with a curved line and a straight line and that can diversify a thickness of a panel that can grasp without changing a driving force transfer mechanism by using an elastic link.

In accordance with an aspect of the present invention, an electric clamping device includes a main body; a drive motor for providing a driving force; a driving force transfer portion for converting and transferring a magnitude of a driving force of the drive motor; a sliding crank having one side connected to the driving force transfer portion and for converting a rotational motion of the driving force transfer portion to a reciprocating motion; a toggle link having one side connected to the other side of the sliding crank and including an elastically deformable link; and a clamp having one side connected to the toggle link and having the other side for clamping or unclamping an object.

The driving force transfer portion may be formed with engagement of a plurality of gears, and an end gear connected to the sliding crank among the plurality of gears may have a speed slower than a rotational speed of the drive motor and a driving force larger than that of the drive motor.

The sliding crank may include a crank arm having one side connected to the end gear of the driving force transfer portion and coupled apart in a radial direction from the rotation center of the end gear and having the other side coupled to the toggle link; a crank slider formed between one side and the other side of the crank arm and spaced apart from an imaginary straight line connecting one side and the other side of the crank arm; and a guide groove formed in the main body and for providing a movement path of the crank slider.

The guide groove may include a curve section formed adjacent to the end gear and a straight section extended from the curve section.

One side of the crank arm may perform a rotational reciprocating motion along a rotation of the end gear, and the other side of the crank arm may perform a linear reciprocating motion along the guide groove.

The toggle link may include an elastic link having one side connected to the other side of the crank arm and capable of being elastically deformed; and a rotation link having one side connected to the other side of the elastic link and having the other side connected to the clamp and that fixes a position of a connecting portion and that rotatably connects the connecting portion and for clamping or unclamping the clamp according to an operation of the elastic link.

The elastic link may have a central portion thicker than both end portions, and in the central portion, a plurality of slits intersecting an imaginary straight line may be formed toward the imaginary straight line connecting connection portions of one side and the other side of the elastic link.

The plurality of slits may be formed not to overlap with each other at a predetermined interval in an imaginary straight line direction.

The plurality of slits may be formed in a wave shape.

The clamp may include a clamp body having one side connected to the rotation link and that fixes a position of a connecting portion and that rotatably connects the connecting portion; a clamp tip protruded from the other side of the clamp body and contacting the object; a locator body positioned within a radius of rotation of the clamp body and fixed to the body; and a locator tip protruded from the locator body and positioned to correspond to a position of the clamp tip according to a rotation of the clamp body and for grasping the object together with the clamp tip.

BRIEF DESCRIPTION OF THE DRAWINGS

The objects, features, and advantages of the present invention will be more apparent from the following detailed description in conjunction with the accompanying drawings, in which.

DETAILED DESCRIPTION OF EMBODIMENTS

Hereinafter, exemplary embodiments of the present invention will be described in detail with reference to the accompanying drawings. The same reference numbers are used throughout the drawings to refer to the same or like parts. Further, detailed descriptions of well-known functions and structures incorporated herein may be omitted to avoid obscuring the subject matter of the present invention.

Figure 1:
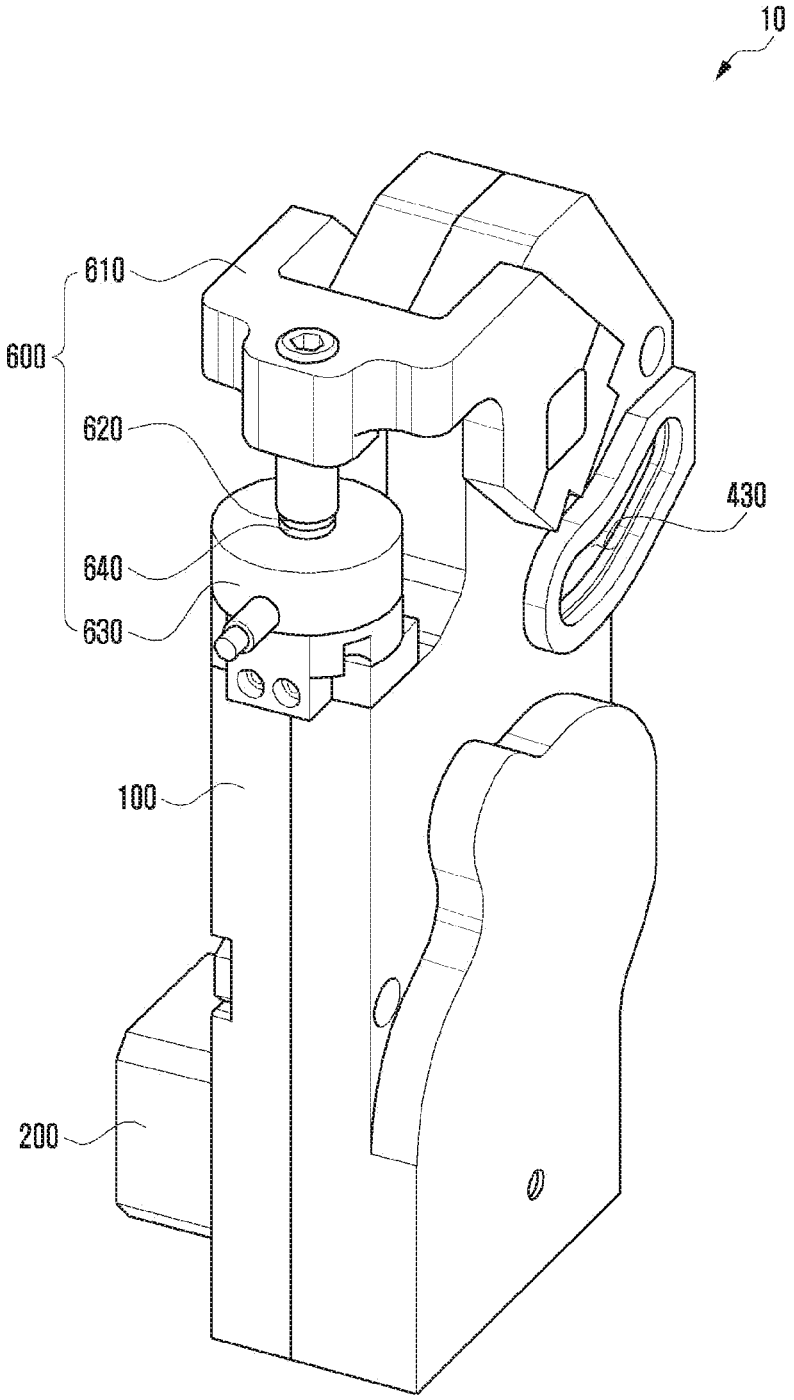
FIG. 1 is a perspective view illustrating an electric clamping device according to an embodiment of the present invention.
Figure 2:
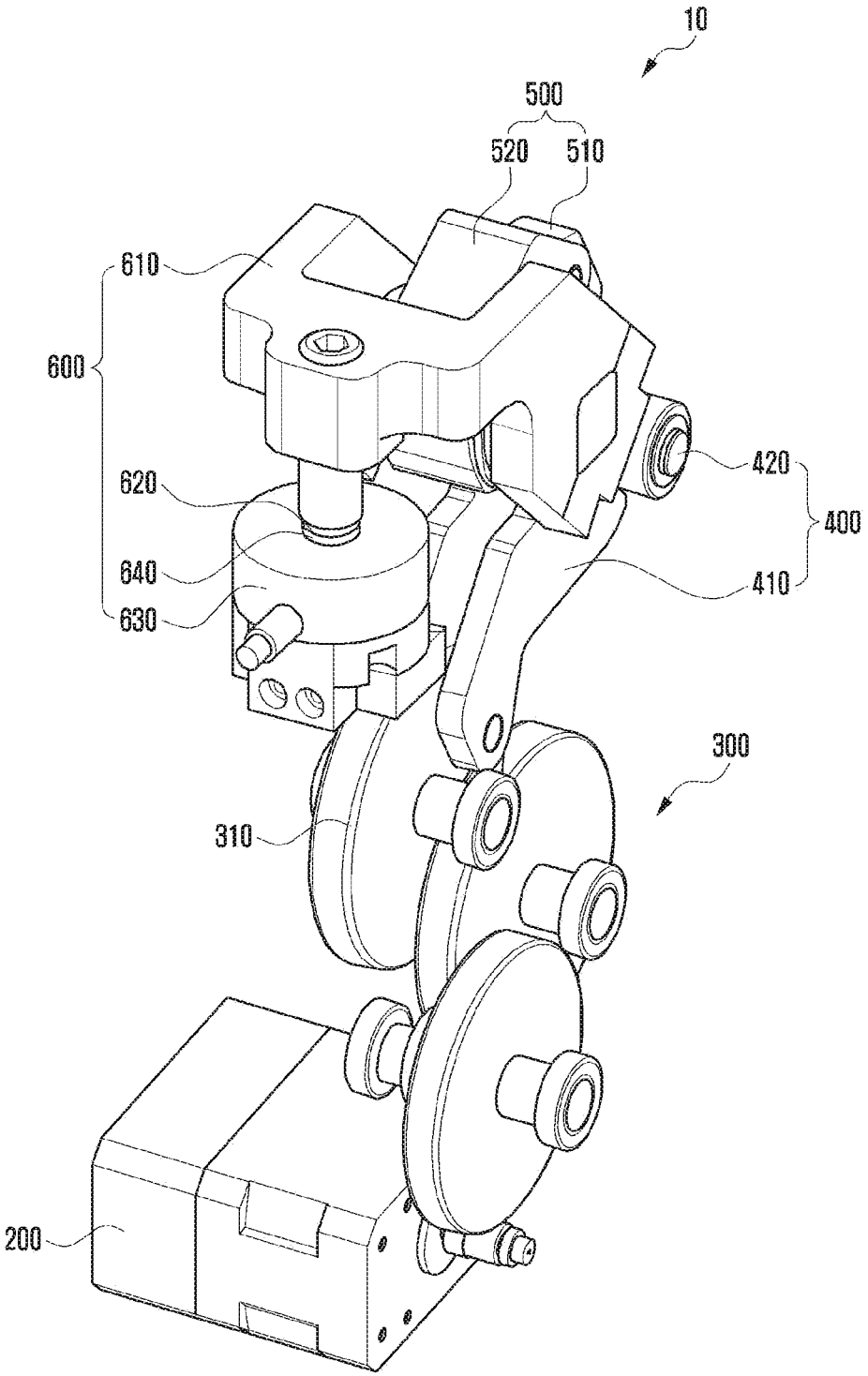
FIG. 2 is a perspective view illustrating an internal structure of an electric clamping device according to an embodiment of the present invention.
Figure 3:
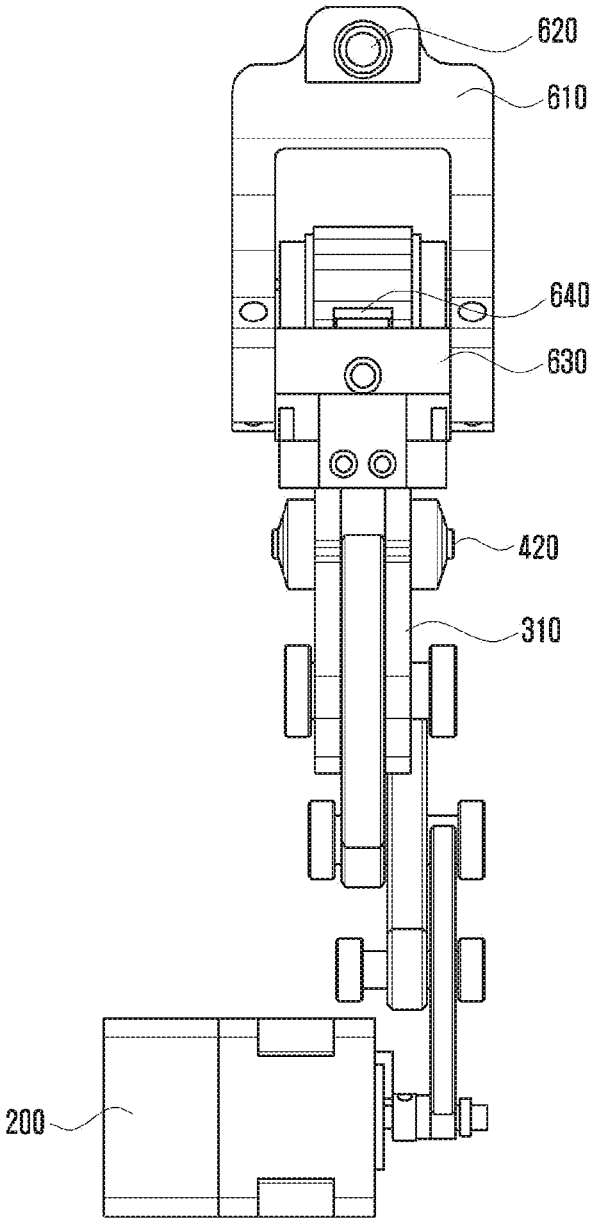
FIG. 3 is a front view illustrating an internal structure of an electric clamping device according to an embodiment of the present invention.

FIG. 1 is a perspective view illustrating an external shape of an electric clamping device 10 according to an embodiment of the present invention, FIG. 2 is a perspective view illustrating an internal structure of the electric clamping device 10, and FIG. 3 is a front view illustrating an internal structure of the electric clamping device 10.

With reference to FIGS. 1 to 3, the electric clamping device 10 according to an embodiment of the present invention may include a main body 100, drive motor 200, driving force transfer portion 300, sliding crank 400, toggle link 500, and clamp 600.

The main body 100 according to an embodiment of the present invention may have a housing form that receives the driving force transfer portion 300, the sliding crank 400, and the toggle link 500. The main body 100 may protect an operation of the driving force transfer portion 300, the sliding crank 400, and the toggle link 500 so as not to be interfered by an external force while forming an external form of the electric clamping device 10.

The drive motor 200 according to an embodiment of the present invention provides a driving force for operating the driving force transfer portion 300, the sliding crank 400, and the toggle link 500 and may be received in the main body 100 and be exposed to the outside of the main body 100. The drive motor 200 may be a servo motor capable of adjusting a rotation direction and the number of revolutions, but the present invention is not limited thereto and various types of motors such as a direct current (DC) motor, alternating current (AC) motor, induction motor, and brushless motor may be used.

Hereinafter, a specific structure of the electric clamping device 10 according to an embodiment of the present invention will be described with reference to FIGS. 4 to 7.

Figure 4:
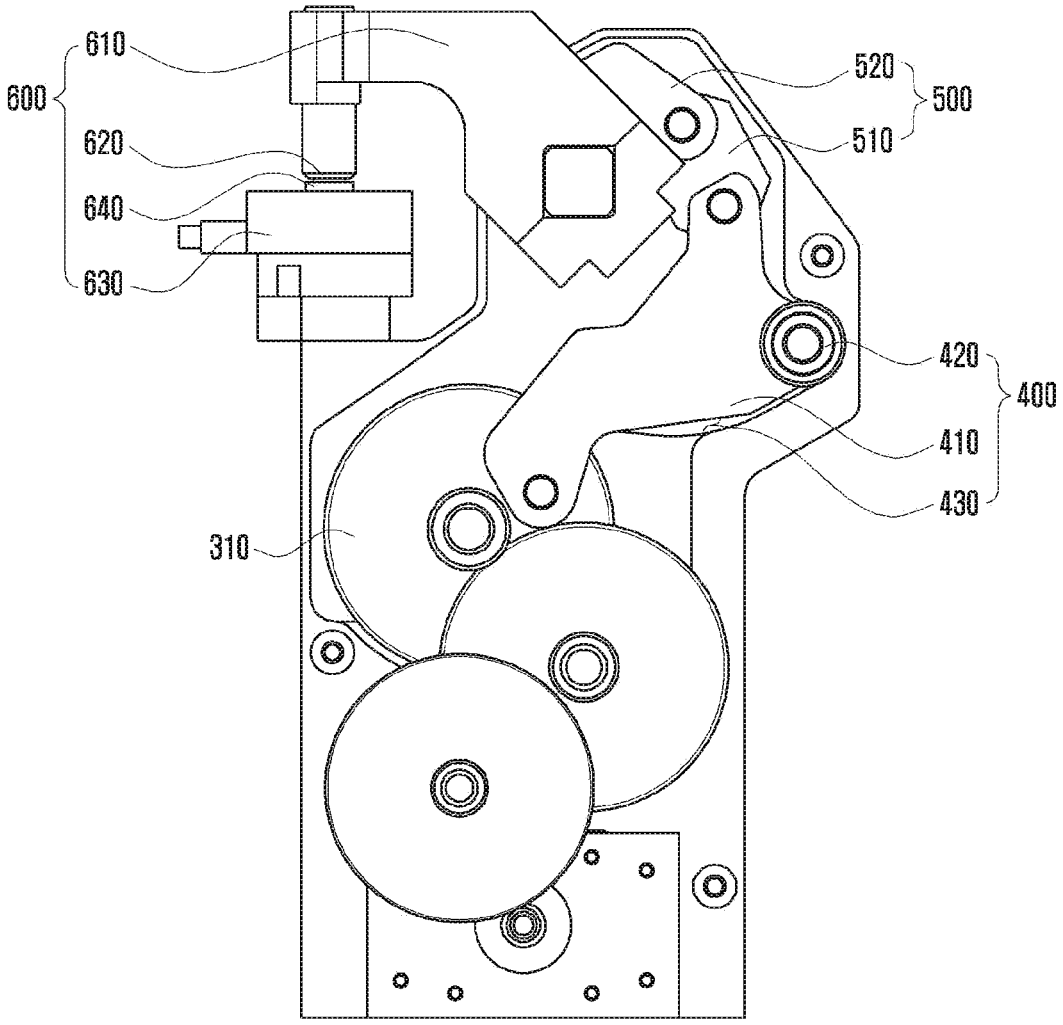
FIG. 4 is a diagram illustrating a clamping state of an electric clamping device according to an embodiment of the present invention.
Figure 5:
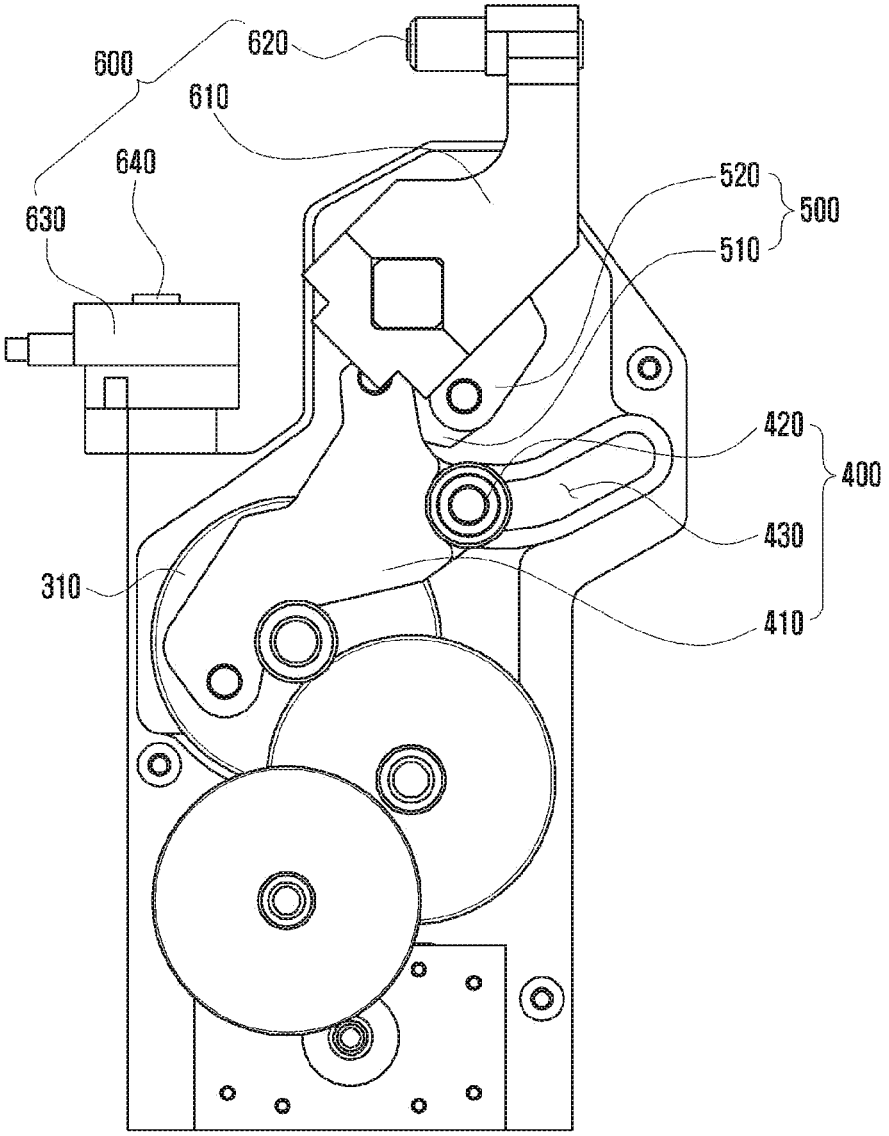
FIG. 5 is a diagram illustrating an unclamping state of the electric clamping device according to an embodiment of the present invention.
Figure 6:
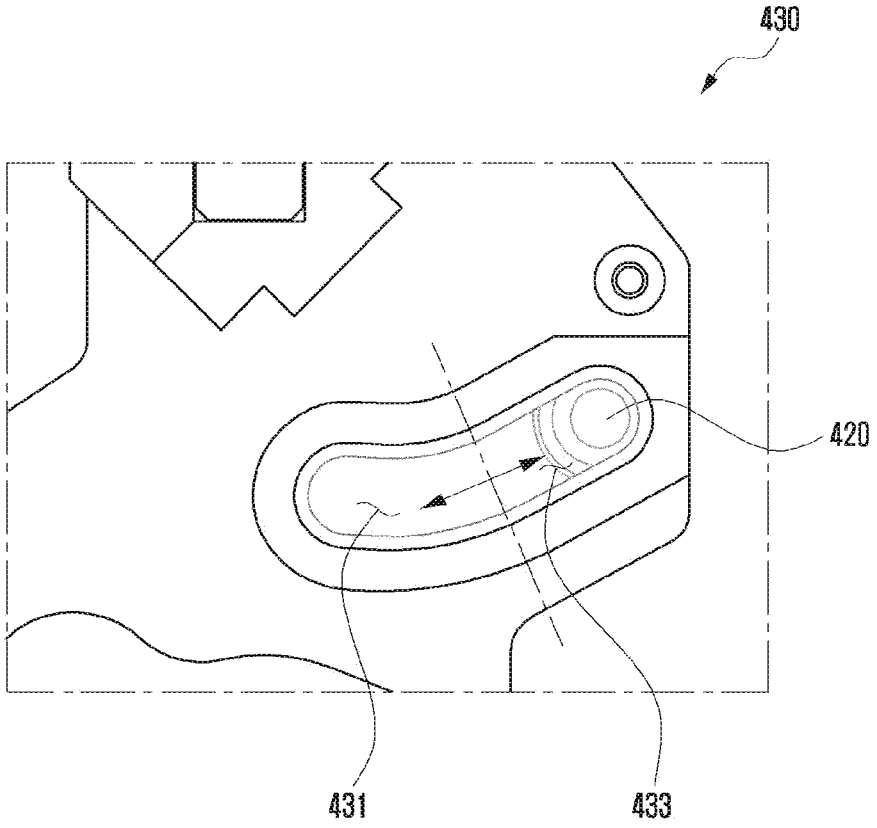
FIG. 6 is an enlarged view illustrating a guide groove of an electric clamping device according to an embodiment of the present invention.
Figure 7:
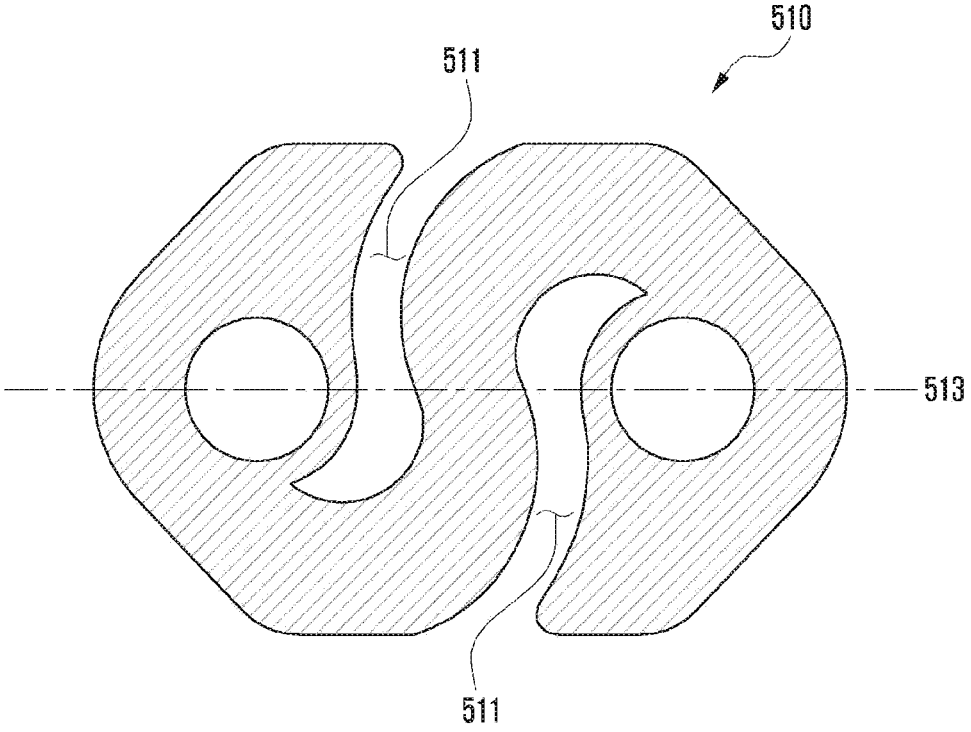
FIG. 7 is a diagram illustrating an elastic link of an electric clamping device according to an embodiment of the present invention.

FIG. 4 is a diagram illustrating a clamping state of an electric clamping device 10 according to an embodiment of the present invention, FIG. 5 is a diagram illustrating an unclamping state of the electric clamping device 10 according to an embodiment of the present invention, FIG. 6 is an enlarged view illustrating a guide groove 430 of the electric clamping device 10 according to an embodiment of the present invention, and FIG. 7 is a diagram illustrating an elastic link 510 of the electric clamping device 10 according to an embodiment of the present invention.

With reference to FIGS. 4 and 5, the driving force transfer portion 300 according to the embodiment of the present invention may be connected to the drive motor 200 to convert and transfer a driving force of the drive motor 200 to the sliding crank 400 to be described later. The driving force transfer portion 300 may be formed with engagement of a plurality of gears having different sizes. For example, the driving force transfer portion 300 may be formed with engagement of a plurality of spur gears having different numbers of teeth by different sizes. Gears of different sizes are engaged; thus, a gear ratio is formed, whereby the number of rotation and a driving force of the drive motor 200 may be converted to be transferred to the sliding crank 400. Specifically, the number of rotation of an end gear 310 directly connected to the sliding crank 400 may be lowered and a driving force of the end gear 310 may be increased, compared with the number of rotation and a driving force of the drive motor 200.

Although a case is described in which a spur gear is applied as an example of the driving force transfer portion 300 according to the embodiment of the present invention, any gear having a configuration that may transfer a driving force of the drive motor 200 is available and the present invention is not limited thereto. For example, as the driving force transfer portion 300, a worm wheel and worm gear structure or a helical gear may be applied.

The sliding crank 400 according to the embodiment of the present invention may include a crank arm 410, a crank slider 420, and a guide groove 430. One side of the sliding crank 400 is connected to the end gear 310 of the driving force transfer portion 300 and the other side thereof is connected to the toggle link 500 to be described later, and as the crank slider 420 moves along the guide groove 430, a rotational motion of the driving force transfer portion 300 may be converted to a linear reciprocating motion.

Specifically, one side of the crank arm 410 may be connected to the end gear 310 and the crank arm 410 may be spaced apart a predetermined distance in a radial direction from the rotation center of the end gear 310. In this case, the crank arm 410 and the end gear 310 are coupled apart from each other by a predetermined distance, thereby transferring a force to push or pull the crank arm 410 according to a forward rotation or a reverse rotation of the end gear 310.

The crank arm 410 according to an embodiment of the present invention may include a crank slider 420, and the crank slider 420 may be protruded from the crank arm 410. The crank slider 420 is inserted into the guide groove 430 to be described later to move along the guide groove 430. When the electric clamping device 10 grasps an object such as a panel, the crank slider 420 may have a configuration of receiving a largest load in a process in which a driving force transferred from the drive motor 200 is transferred to the panel and a weight of the panel transferred through the clamp 600 and the toggle link 500. The crank slider 420 should move along the guide groove 430 in a state that receives a load and the toggle link 500 and may reduce a friction using a bearing of a cylindrical shape.

The crank slider 420 according to an embodiment of the present invention is positioned between one side in which the crank arm 410 is connected to the end gear 310 and the other side in which the crank arm 410 is connected to the toggle link 500 and may be deviated from an imaginary straight line connecting one side and the other side of the crank arm 410. Portions in which a force operates in the crank arm 410 may be total three portions of one side that receives a driving force from the end gear 310, the other side connected to the elastic link 510 of the toggle link 500 to be described later, and the crank slider 420 that moves along the guide groove 430. In this case, the crank slider 420 is positioned to deviate from an imaginary straight line connecting one side and the other side of the crank arm 410, and the crank slider 420 moves along the guide groove 430 and serves as a support point; thus, a direction of a force transferred from the end gear 310 to the crank arm 410 is bent about the crank slider 420, whereby the force is transferred to the elastic link 510.

With reference to FIG. 6, the guide groove 430 according to an embodiment of the present invention may be formed in the main body 100 and provide a moving path of the crank slider 420. The guide groove 430 may form a curve section 431 adjacent to the end gear 310 and may be extended from the curve section 431 to form a straight section 433.

The curve section 431 may be involved in a range in which the clamp body 100 forms a gap, and the straight section 433 may be involved in a grasping force in which the clamp body 100 grasps the panel. With reference to the clamping and unclamping state diagrams of FIGS. 4 and 5, a range in which a clamp body 610 forms a gap may be affected by a moving distance of the crank slider 420 in the left-right direction, and a grasping force of the clamp body 610 may be affected by a moving distance in the up and down direction.

With reference to FIG. 4 or 5, the guide groove 430 is formed in a diagonally right-up direction from the left and forms a curve section 431 in the left-right direction to increase a moving radius in the left-right direction of the crank slider 420, thereby increasing a range in which the clamp body 610 forms a gap. However, to form a curved line instead of a straight line in the left-right direction is to prevent the crank slider 420 from not being moved by the guide groove 430 when the end gear 310 is initially driven in a state illustrated in FIG. 5. One side of the crank arm 410 may be formed in a curved line according to driving in a curved line at an early stage along the end gear 310. After the curve section, the clamp body 610 may be gradually clamped through the diagonal straight section 433 of a right upward direction to strongly grasp the panel.

The toggle link 500 according to the embodiment of the present invention may be connected to the clamp 600 and transfer a rotational force to the clamp 600 to rotate the clamp 600 in a clamping or unclamping state. The toggle link 500 may include an elastic link 510 and a rotation link 520.

One side of the elastic link 510 is connected to the other side of the crank arm 410, and when the crank arm 410 is operated, the elastic link 510 may rotate about a connection portion. One side of the rotation link 520 may be connected to the other side of the elastic link 510 and the other side of the rotation link 520 may be connected to the clamp body 610. However, the other side of the rotation link 520 may be installed so that the connection portion together with the clamp body 610 is fixed to the main body 100 and may be installed to rotate about the corresponding position. That is, the clamp body 610 may serve to fix and provide the center of rotation of the clamping and unclamping processes.

The elastic link 510 according to an embodiment of the present invention may be elastically deformed within a predetermined range.

For example, the unclamping state of FIG. 5 is converted to the clamping state of FIG. 4, and when the panel is grasped, in the case of a thin panel, the panel may be grasped without being damaged by elastic deformation of a locator tip 640 or a clamp tip 620 to be described later even in a state of FIG. 4. However, when a panel having a predetermined thickness or more is grasped, it may be necessary to adjust a configuration of the sliding crank 400 or the toggle link 500 in consideration of the thickness of the panel. For example, in the clamping state illustrated in FIG. 4, when the clamp tip 620 and the locator tip 640 are adjusted to slightly have a gap, a thick panel may be grasped without damaging.

However, in the electric clamping device 10 according to the embodiment of the present invention, when the elastic link 510 of the toggle link 500 absorbs a portion that should be adjusted in the sliding crank 400 or the toggle link 500 by a thickness difference of the panel, panels of various thicknesses may be grasped without being damaged through elastic deformation.

With reference to FIG. 7, the elastic link 510 according to an embodiment of the present invention may have a rod shape as a whole, have a thicker center portion therebetween than both end portions, and have a plurality of slits 511 formed at a central portion thereof.

The slit 511 according to an embodiment of the present invention may be formed to be recessed inward from an edge portion of the center thereof, and when an imaginary straight line connecting one side and the other side of the elastic link 510 is drawn, the slits 511 may be formed to intersect an imaginary straight line without intersecting each other. That is, the slits 511 may be spaced apart from each other in an imaginary straight line direction not to be overlapped each other. The slits 511 may be formed in a wave shape and may be formed to be symmetrical based on a central point of the elastic link 510. As the slit 511 is formed in a wave shape, a bending point may be reduced at which a stress is concentrated, compared with when the slit 511 is formed in a straight line and the thickness of the elastic link 510 may be partially adjusted.

For example, in the case of the slit 511 formed at the left with reference to the state of FIG. 7, a thickness of the slit 511 at a lower end portion may be different from a thickness of a portion in which depression starts at the upper side. In this manner, an elastic modulus value may be adjusted by adjusting the thickness, and the slit 511 may have the best durability to withstand repeated elastic deformation.

The clamp 600 according to an embodiment of the present invention may include a clamp body 610, clamp tip 620, locator body 630, and locator tip 640.

The clamp body 610 according to an embodiment of the present invention is installed to be exposed to the outside of the main body, and one side of the clamp body 610 is rotatably installed to the main body together with a connecting portion of the other side of the rotation link 520.

The clamp tip 620 according to an embodiment of the present invention is protruded toward the locator tip 640 at the other side of the clamp body 610 to grasp the panel seated at the locator tip 640. In this case, the clamp tip 620 may be detachably installed by a screw fastening structure and the like, and as the clamp tip 620 is detachably installed, when the clamp tip 620 is damaged and worn, only the clamp tip 620 may be exchanged easily.

Further, the end of the clamp tip 620 may directly contact the panel in a grasping process of the panel and may be formed in a round shape to prevent scratches on the surface of the panel, and may be made of an elastic material.

The electric clamping device 10 according to an embodiment of the present invention may further include a locator body 630 and a locator tip 640. However, the electric clamping device 10 may selectively include according to the type and size of the object to be grasped.

The locator body 630 according to an embodiment of the present invention may be disposed outside the body, and a grasping object such as a panel is seated on the locator body 630. In a process of clamping the object to be clamped by the clamp body 610, the locator body 630 may serve as a support. The locator body 630 may be integrally formed with the main body, or may be separately produced to be coupled to the main body.

The locator tip 640 according to an embodiment of the present invention may be protruded from the locator body 630 to support a clamping object. Even if a grasping space of the panel is insufficient, the protruding type locator tip 640 may clamp. Although not illustrated, the locator tip 640 may be detachably installed by a screw fastening structure, and the locator tip 640 may be installed to adjust a height by a rotation of a screw fastening structure according to a form of the panel. An end portion in which the locator tip 640 meets the clamp tip 620 is a portion that directly contacts the panel and may be rounded to prevent the surface of the panel from being damaged, such as generating scratches on the surface when the panel is seated and be made of an elastic material.

A process of connecting from FIG. 4 to FIG. 5 may be an unclamping operation, and a process of connecting from FIG. 5 to FIG. 4 may be a clamping operation.

With reference to FIG. 4, when the drive motor rotates clockwise, the end gear of the driving force transfer portion rotates counterclockwise. In this case, one side of the crank arm moves gradually in a leftward direction according to a rotation of the end gear, and the crank slider starts to move along a straight section of the guide groove. When the crank slider moves along the straight section and the curve section, the crank arm rotates clockwise about the crank slider as an axis, and the elastic link pulls the rotation link 520; thus, the clamp body 610 is unclamped while rotating clockwise.

Conversely, with reference to FIG. 5, when the drive motor rotates counterclockwise, the end gear of the driving force transfer portion rotates clockwise. In this case, one side of the crank arm moves gradually in a rightward direction according to a rotation of the end gear, and the crank slider starts to move along the curve section of the guide groove. The crank slider may be easily moved without being caught by the guide groove along the curve section of the guide groove, and when the crank slider moves along the curve section and the straight section, the crank arm rotates counterclockwise about the crank slider as an axis, and the elastic link pushes the rotation link 520, whereby the clamp body 610 is clamped while rotating counterclockwise.

FIGS. 8A to 10 are diagrams illustrating an elastic link according to various embodiments of the present invention.

Figure 8A:
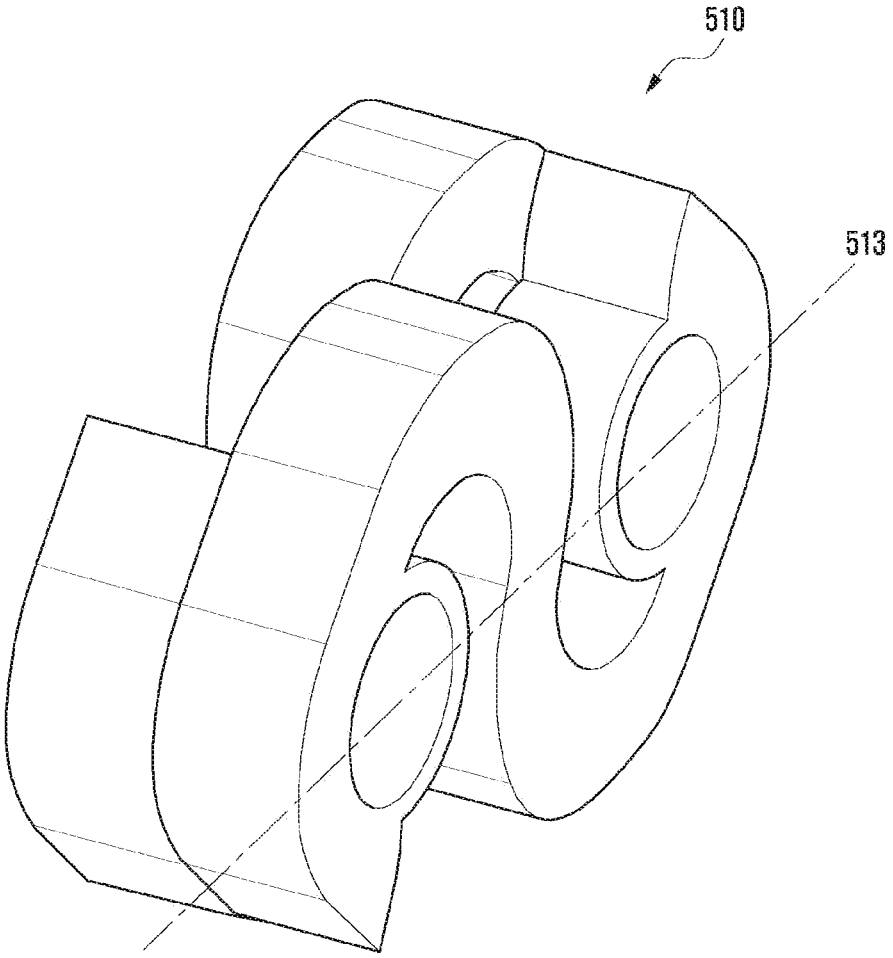
FIGS. 8A to 10 are diagrams illustrating an elastic link according to various embodiments of the present invention.
Figure 8B:
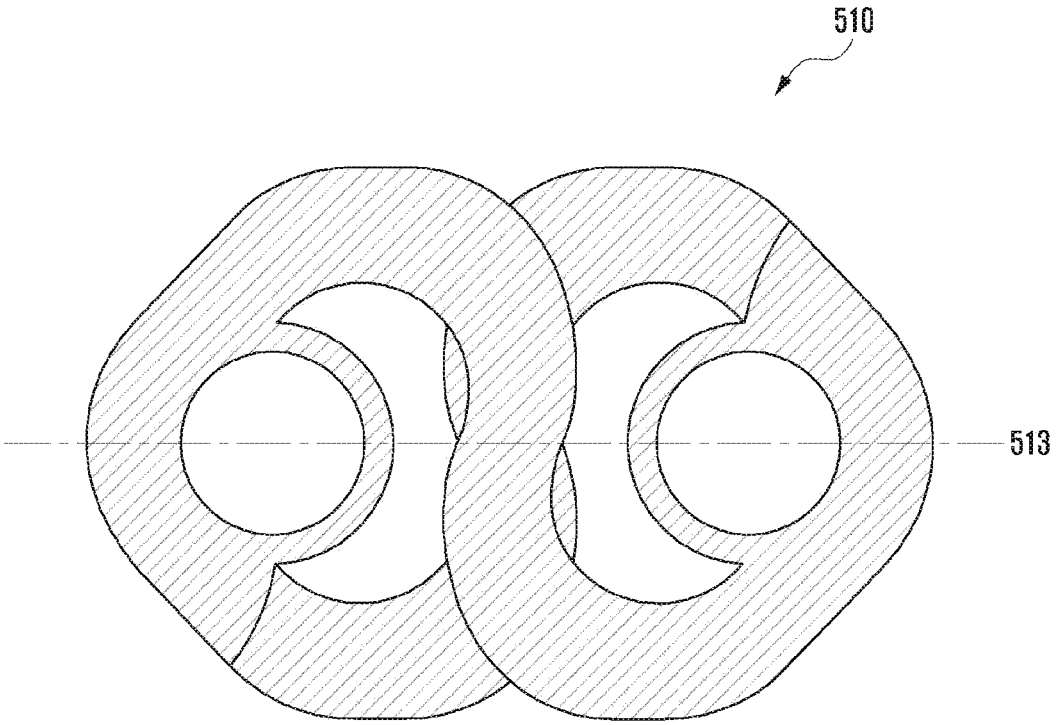

FIGS. 8A and 8B are diagrams illustrating a plurality of elastic links 510 overlapped each other according to another embodiment of the present invention. The plurality of elastic links 510 may be disposed to be overlapped each other so that shapes of the elastic links 510 are not overlapped each other. By disposing the plurality of elastic links 510 in an overlapping manner, even if one elastic link 510 is broken in an operation process of the electric clamping device, other elastic links 510 may maintain an operation state of the electric clamping device.

Figure 9:
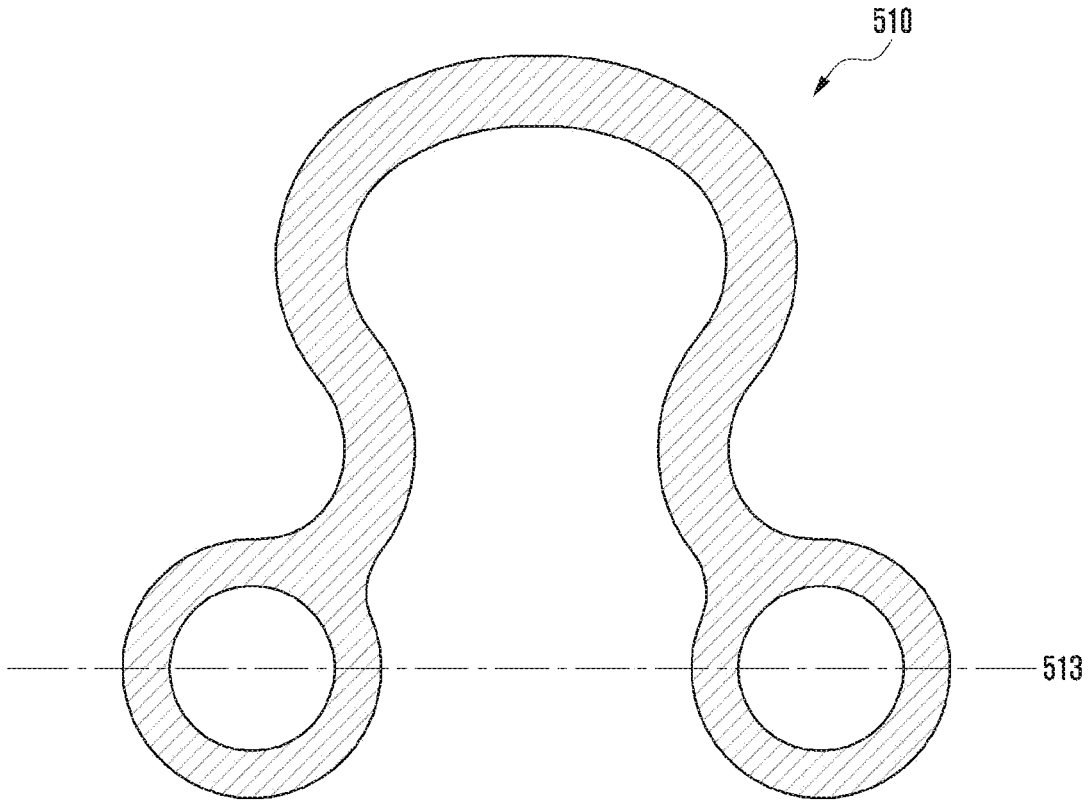

FIG. 9 is a diagram illustrating the elastic link 510 formed in a horseshoe shape according to another embodiment of the present invention. Although not illustrated separately, a plurality of elastic links 510 of FIG. 9 may be disposed to be overlapped with each other so that shapes of the plurality of elastic links 510 is not overlapped with each other.

Figure 10:
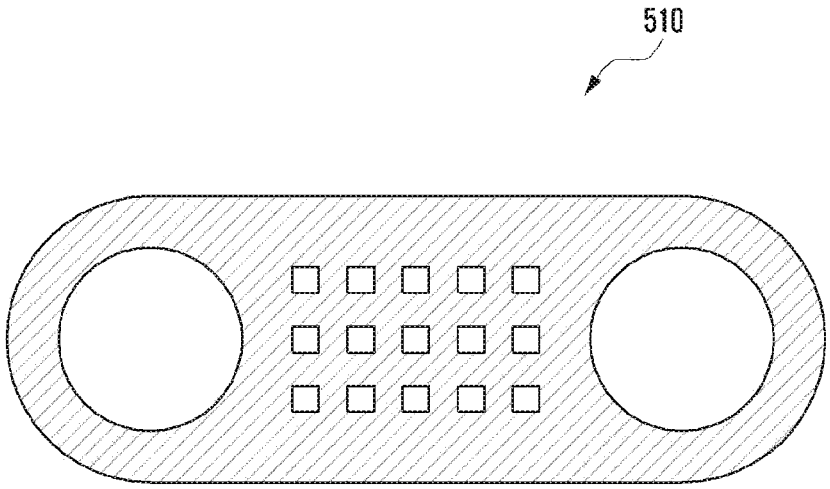

FIG. 10 is a diagram illustrating an elastic link 510 according to another embodiment of the present invention and illustrating a form in which a plurality of holes is formed between one side and the other side of the elastic link 510. The elastic coefficient of the elastic link 510 may be adjusted by adjusting the number and a pattern size of holes.

An electric clamping device according to an embodiment of the present invention includes a main body; a drive motor for providing a driving force; a driving force transfer portion for converting and transferring a magnitude of a driving force of the drive motor; a sliding crank having one side connected to the driving force transfer portion and for converting a rotational motion of the driving force transfer portion to a reciprocating motion; a toggle link having one side connected to the other side of the sliding crank and including an elastically deformable link; and a clamp having one side connected to the toggle link and having the other side for clamping or unclamping an object.

The driving force transfer portion may be formed with engagement of a plurality of gears, and an end gear connected to the sliding crank among the plurality of gears may have a speed slower than a rotational speed of the drive motor and a driving force larger than that of the drive motor.

The sliding crank may include a crank arm having one side connected to an end gear of the driving force transfer portion and coupled apart in a radial direction from the rotation center of the end gear and having the other side coupled to the toggle link; a crank slider formed between one side and the other side of the crank arm and spaced apart from an imaginary straight line connecting one side and the other side of the crank arm; and a guide groove formed in the main body and for providing a movement path of the crank slider.

The guide groove may include a curve section formed adjacent to the end gear and a straight section extended from the curve section.

One side of the crank arm may perform a rotational reciprocating motion along a rotation of the end gear, and the other side of the crank arm may perform a linear reciprocating motion along the guide groove.

The toggle link may include an elastic link having one side connected to the other side of the crank arm and capable of being elastically deformed; and a rotation link having one side connected to the other side of the elastic link and having the other side connected to the clamp and that fixes a position of a connecting portion and that rotatably connects the connecting portion and for clamping or unclamping the clamp according to an operation of the elastic link.

The elastic link may have a central portion thicker than both end portions, and in the central portion, a plurality of slits 511 intersecting an imaginary straight line may be formed toward the imaginary straight line connecting connection portions of one side and the other side of the elastic link.

The plurality of slits 511 may be formed not to overlap with each other at a predetermined interval in an imaginary straight line direction.

The plurality of slits 511 may be formed in a wave shape.

The clamp may include a clamp body having one side connected to the rotation link and that fixes a position of a connecting portion and that rotatably connects the connecting portion; a clamp tip protruded from the other side of the clamp body and contacting the object; a locator body positioned within a radius of rotation of the clamp body and fixed to the body; and a locator tip protruded from the locator body and positioned to correspond to a position of the clamp tip according to a rotation of the clamp body and for grasping the object together with the clamp tip.

By using a drive motor as a driving source, a size of the device can be minimized, an angle can be increased at which a clamp body is unclamped according to a shape characteristic of a guide groove in a driving force transfer structure for rotating the clamp body, and a grasping force of an object such as a panel can be improved.

Further, panels of various thicknesses can be grasped through an elastic link without changing a driving force transfer mechanism such as a clamp, a toggle link, or a sliding crank.

Although embodiments of the present invention have been described in detail hereinabove, it should be clearly understood that many variations and modifications of the basic inventive concepts herein described, which may appear to those skilled in the art, will still fall within the spirit and scope of the embodiments of the present invention as defined in the appended claims.

What is claimed is:

1. An electric clamping device, comprising:

a main body;

a drive motor for providing a driving force;

a driving force transfer portion for converting and transferring a magnitude of the driving force of the drive motor;

a sliding crank having one side connected to the driving force transfer portion and for converting a rotational motion of the driving force transfer portion to a reciprocating motion, wherein the sliding crank comprises:
a crank arm; and
a crank slider;

a toggle link having one side connected to the other side of the sliding crank;

said toggle link comprising an elastically deformable link; and a clamp having one side connected to the toggle link and having an other side for clamping or unclamping an object;

wherein the driving force transfer portion is formed with engagement of a plurality of gears including an end gear connected to the sliding crank, wherein the end gear has a speed slower than a rotational speed of the drive motor and a driving force larger than that of the drive motor;

said crank arm having one side connected to the end gear of the driving force transfer portion and coupled apart in a radial direction from a rotation center of the end gear and having an other side coupled to the toggle link;

said crank slider formed between said one side and the other side of the crank arm and spaced apart from an imaginary straight line connecting said one side and the other side of the crank arm;

a guide groove formed in the main body and for providing a movement path of the crank slider; and wherein the guide groove comprises a curve section formed adjacent to the end gear and a straight section extended from the curve section.

2. The electric clamping device of claim 1, wherein said one side of the crank arm performs a rotational reciprocating motion along a rotation of the end gear, and the other side of the crank arm performs a linear reciprocating motion along the guide groove.

3. The electric clamping device of claim 2, wherein the toggle link further comprises: the elastic link having one side connected to the other side of the crank arm and capable of being elastically deformed; and a rotation link having one side connected to an other side of the elastic link and said rotation link having an other side connected to the clamp and that fixes a position of a connecting portion and that rotatably connects the connecting portion and for clamping or unclamping the clamp according to an operation of the elastic link.

4. The electric clamping device of claim 3, wherein the elastic link has two end portions and a central portion thicker than both end portions, and in the central portion, a plurality of slits intersecting an imaginary straight line is formed toward the imaginary straight line connecting connection said end portions of one side and the other side of the elastic link.

5. The electric clamping device of claim 4, wherein the plurality of slits are formed not to overlap with each other in the imaginary straight line direction.

6. The electric clamping device of claim 5, wherein the plurality of slits is formed in a wave shape.

7. The electric clamping device of claim 6, wherein the clamp comprises:

a clamp body rotatably connecting to the rotation link, said clamp body having one side connected to the rotation link wherein said claim body fixes a position of a connecting portion;

a clamp tip protruded from an other side of the clamp body and contacting the object;

a locator body positioned within a radius of rotation of the clamp body and fixed to the body; and a locator tip protruded from the locator body and positioned to correspond to a position of the clamp tip according to a rotation of the clamp body and for grasping the object together with the clamp tip.

8. The electric clamping device of claim 6, wherein a plurality of elastic links is formed to be overlapped.

9. The electric clamping device of claim 8, wherein the plurality of elastic links are overlapped with each other so that the wave shapes of each of the plurality of elastic links thereof are not overlapped.

10. The electric clamping device of claim 3, wherein a plurality of holes is formed between the one side and the other side of the elastic link.

* * * * *